US005385797A

United States Patent [19]

Nagahara et al.

[11] Patent Number: 5,385,797

[45] Date of Patent: Jan. 31, 1995

[54] ELECTROPHOTOGRAPHIC PHOTOSENSITIVE MEMBER, AND ELECTROPHOTOGRAPHIC APPARATUS, DEVICE UNIT, AND FACSIMILE MACHINE EMPLOYING THE SAME

[75] Inventors: Shin Nagahara, Inagi; Akio Maruyama, Tokyo; Haruyuki Tsuji, Yokohama, all of Japan

[73] Assignee: Canon Kabushiki Kaisha, Tokyo, Japan

[21] Appl. No.: 948,252

[22] Filed: Sep. 21, 1992

[30] Foreign Application Priority Data

Sep. 24, 1991 [JP] Japan ..... 3-243306

[51] Int. Cl.[6] ..... G03G 5/14

[52] U.S. Cl. ..... 430/67; 355/211; 358/401

[58] Field of Search ..... 430/66, 67; 355/211; 358/401

[56] References Cited

U.S. PATENT DOCUMENTS 5,162,184 11/1992 Aizawa ..... 430/67

5,190,837 3/1993 Sakai et al. ..... 430/65

FOREIGN PATENT DOCUMENTS 57-30843 2/1982 Japan .

*Primary Examiner*—John Goodrow

*Attorney, Agent, or Firm*—Fitzpatrick, Cella, Harper & Scinto

[57] ABSTRACT

An electrophotographic photosensitive member has an electroconductive support, a photosensitive layer, and a protection layer in named order. The protection layer contains a binder resin and a particulate electroconductive material. The particulate electroconductive material has been treated for adhesion of a siloxane compound represented by Formula (1) and subsequently is heat-treated at a temperature of not lower than 120° C.

23 Claims, 1 Drawing Sheet

ELECTROPHOTOGRAPHIC PHOTOSENSITIVE MEMBER, AND ELECTROPHOTOGRAPHIC APPARATUS, DEVICE UNIT, AND FACSIMILE MACHINE EMPLOYING THE SAME

BACKGROUND OF THE INVENTION

1. Field of the Invention

The present invention relates to an electrophotographic photosensitive member having a surface protection layer. More particularly, the present invention relates to an electrophotographic photosensitive member having a protection layer containing electroconductive particles which are surface-treated with a specified compound. The present invention further relates to an electrophotographic apparatus, a device unit, and a facsimile machine employing the above electrophotographic photosensitive member.

2. Related Background Art

Electrophotographic photosensitive members are naturally required to have sufficient sensitivity and electrical and optical characteristics necessary for the electrophotographic process to which they are applied. Additionally, the photosensitive member which are used repeatedly are required to be stable to external electrical and mechanical actions such as charging, development, image-transfer, and cleaning. Specifically, the photosensitive members are required to be resistant to wearing and scratching by friction at the surface and to deterioration caused by ozone and NOx. Furthermore, the photosensitive members are required to have excellent cleanability to prevent sticking of a toner on the surface thereof.

A method to satisfy the above-mentioned characteristics required of the photosensitive member is to provide a surface protecting layer mainly composed of a resin on the photosensitive layer. In one example of the protecting layer, a metal oxide is incorporated as an electroconductive powder to control the electric resistance as disclosed in Japanese Patent Application Laid-Open No. 57-30843.

The metal oxide is added to the protecting layer of the electrophotographic photosensitive member mainly for the purpose of controlling the electric resistance of the protecting layer itself to prevent the increase of residual potential in the photosensitive member during repeated use of the electrophotographic process. The protection layer of the electrophotographic photosensitive member has an electric resistance preferably in a range of from $10^{10}$ to $10^{15}$ Ω·cm. However, the electric resistance is liable to be affected greatly by ionic conduction and tends to change significantly depending on environmental conditions. In particular, the protection layer containing a metal oxide dispersed therein cannot necessarily retain the resistance within the above defined range in all environmental conditions during repeated use in the electrophotographic process because of the hygroscopicity of the surface of the metal oxide.

In the case where a particulate material is dispersed in the protection layer, the particles have desirably a diameter less than the wavelength of incident light, namely less than 0.3 μm to prevent scattering the incident light by the dispersed particles. Fine particles, however, tend generally to aggregate and are not readily uniformly dispersed, and moreover, the particles once dispersed are liable to cause secondary aggregation or sedimentation. Therefore, it was extremely difficult to prepare stably a film that contains fine particles of 0.3 μm or less in diameter dispersed therein. From the standpoint of improving the transparency and the uniformity of electric conduction of the layer, it is desired that ultra-fine particles having a much smaller diameter (primary particle diameter of 0.1 μm or less) are dispersed. However, the dispersibility and the dispersion stability of such ultra-fine particles tend to be lower.

Particularly at high humidity, paper powder, or corona discharge products, such as ozone and NOx, caused by charging are liable to adhere to the surface of the photosensitive member, leading to decrease of the surface resistance, and causing blurring or running of images.

With the recent demand for higher quality of images and higher durability, electrophotographic photosensitive members are being investigated which are capable of giving excellent images more stably under any environmental conditions.

SUMMARY OF THE INVENTION

An object of the present invention is to provide an electrophotographic photosensitive member which has an excellent lubricity and is resistant to wearing and scratching by friction.

Another object of the present invention is to provide an electrophotographic photosensitive member which is free from reductions the surface resistance caused by adhesion of corona discharge products even when repeatedly used in an electrophotographic process, and is capable of giving high quality of images even under high humidity conditions.

Still another object of the present invention is to provide an electrophotographic photosensitive member which exhibits stable electrophotographic characteristics without accumulation of residual potential and decrease of sensitivity when repeatedly used in an electrophotographic process.

Further objects of the present invention are to provide an electrophotographic apparatus, a device unit, and a facsimile machine which employ the above electrophotographic photosensitive member.

The present invention provides an electrophotographic photosensitive member, comprising an electroconductive support, a photosensitive layer, and a protection layer in named order, the protection layer containing a binder resin and a particulate electroconductive material, the particulate electroconductive material having been treated for adhesion of a siloxane compound represented by Formula (1) and subsequently being heat-treated at a temperature of not lower than 120° C.:

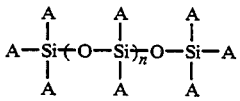

(1)

wherein A group is a hydrogen atom or a methyl group, the ratio of the number of the hydrogen atoms to the total number of the A groups is in a range of from 0.1 to 50%, and n is an integer of 0 or more.

The present invention provides also an electrophotographic apparatus, a device unit, and a facsimile machine which employ the above electrophotographic photosensitive member.

DESCRIPTION OF THE PREFERRED EMBODIMENT

Figure 1:
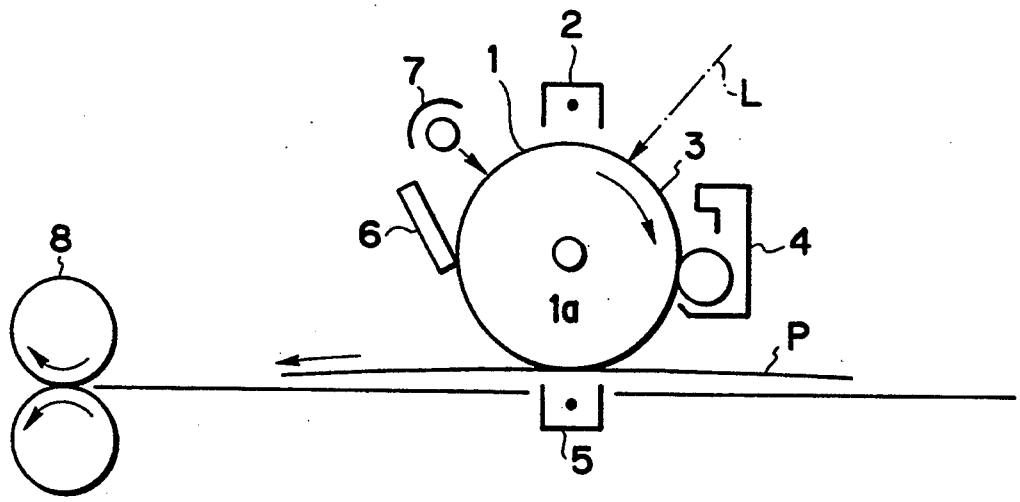
FIG. 1 illustrates schematically an example of the constitution of an electrophotographic apparatus employing the electrophotographic photosensitive member of the present invention.

In the present invention, a coating liquid is prepared by use of an electroconductive particulate material to which a siloxane compound is adhered, the siloxane compound being represented by Formula (1):

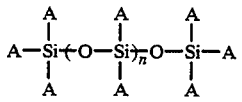

(1)

wherein A group is a hydrogen atom or a methyl group, the ratio of the number of the hydrogen atoms to the total number of the A groups is in a range of from 0.1 to 50%, and n is an integer of 0 or more; and subsequently the particulate material being heat-treated at a temperature of not lower than 120° C. The coating liquid contains the particulate material dispersed satisfactorily therein and is stably storable without secondary aggregation of the dispersed particles. By forming a protection layer with this coating liquid, an electrophotographic photosensitive member is obtained which has excellent electrophotographic characteristics.

The wording "the ratio of the number of the hydrogen atoms to the total number of the A groups" for Formula (1) means the ratio (percent) of the number of the hydrogen atoms bonded to the silicon atoms to the sum of the numbers of the hydrogen atoms and the methyl groups bonded to the silicon atoms. In the present invention, this ratio is in the range of from 0.1 to 50%, preferably from 20 to 50%, more preferably from 35 to 50%. In the present invention, a particularly prefered siloxane compound of Formula (1) has three methyl groups at each terminal silicon atom, and one methyl group and one hydrogen atom on each of the silicon atom in the repeating units. The symbol n in Formula (1) is an integer of 0 or more, preferably an integer in the range of 10 to 100, more preferably from 30 to 70.

The molecular weight of the siloxane of Formula (1) is not specially limited. However, since the viscosity of the coating liquid is desired not to be excessively high in view of the surface coating operation, the weight-average molecular weight is preferably in a range of from 300 to 10,000, more preferably from 1,000 to 4,000.

The method of surface treatment in the present invention, namely the method of coating of the surface of the electroconductive particles with the siloxane compound, is classified roughly into two methods: a wet process and a dry process.

In the wet process, electroconductive particulate material and the siloxane compound of Formula (1) are dispersed in a suitable solvent, and the siloxane compound is made to adhere to the surface of the electroconductive particles. The means for preparation of the dispersion may be a usual dispersion means such as a ball mill and a sand mill. The solvent is removed from the liquid dispersion by drying, and further the particulate material is heat treated to adhere the siloxane compound on the surface of the electroconductive articles.

In the dry process, the siloxane compound and the electroconductive particulate material are mixed and blended without solvent, and other operations are the same as in the wet process.

In the heat treatment of the present invention, it is presumed that the hydrogen in the Si-H bonds of the siloxane compound is oxidized during heat treatment by oxygen in the air and additional siloxane bonds are formed to give three-dimensional structure of the siloxane, and the surface of the electroconductive particles is enclosed by the network structure of the siloxane compound. Accordingly, the the electroconductive particles are dispersed sufficiently and are highly unlikely to cause secondary aggregation or sedimentation of the particles. The conditions of the heat treatment are not limited, provided that crosslinking bonds are formed between siloxane compounds. The heat-treatment temperature is preferably 120° C. or higher, more preferably 150° C. or higher. The heat treatment time is preferably 30 minutes or longer, more preferably one hour or longer.

The electroconductive particles having been treated as above may be pulverized further if necessary in the present invention.

The electroconductive particulate material suitable for use in the present invention includes metals, metal oxides, particulate plastics having a metal or a metal oxide vapor deposited thereon, carbon black, and so forth. The metals include aluminum, zinc, copper, chromium, nickel, stainless steel, silver, and the like. The metal oxides include zinc oxide, titanium oxide, tin oxide, antimony oxide, indium oxide, bismuth oxide, tin-doped indium oxide, antimony-doped tin oxide, and zirconium oxide. These substances may be used alone or in combination of two or more thereof. When used in combination, the substances may be a simple mixture, a solid solution, or a fused matter. Among the electroconductive particulate materials mentioned above, metal oxides are preferred in view of transparency. Among the metal oxides, preferred are tin oxide, indium oxide, tin-doped indium oxide, and antimony-doped tin oxide. The ratio of electroconductive particulate material to the siloxane compound in the present invention depends on particle diameter and the ratio of the methyl group to the hydrogen atom in the siloxane compound. Generally the siloxane compound is used preferably in an amount of from 1 to 50 percent by weight, more preferably from 3 to 40% by weight based on the total weight of the surface-treated electroconductive particles.

In the case where a particulate material is dispersed in the binder resin, the particles have desirably a diameter less than the wavelength of incident light, namely less than 0.3 μm to prevent scattering the incident visible light by the dispersed particles. In view of light transmission which is required for the protection layer, an average diameter of the electroconductive particles in the protection layer is preferably less than 0.3 μm, more preferably less than 0.1 μm. Further, in view of forming the secondary particles during dispersion process, an average diameter of the primary particles of the electroconductive particles before dispersing is preferably less than 0.1 μm, more preferably less than 0.05 μm as ultra fine particles.

An average diameter of the electroconductive particles of the present invention is a mean value of particle diameters of 100 electroconductive particles measured by SEM (Scanning Electron Microscope) in the case of the primary particles of the electroconductive particles before dispersing, and in the case of the electroconductive particles in the protection layer is a mean value of particle diameters of 30 electroconductive particles measured by TEM (Transmission Electron Microscope).

The binder resin for the protection layer employed in the present invention includes acrylics, polyester, polycarbonate, polystyrene, cellulose, polyethylene, polypropylene, polyurethane, epoxy, silicone, polyvinyl chloride, and the like. Of these resins, curable resins are preferred in view of the surface hardness and the wear resistance of the protection layer, and dispersibility of the fine particles and stability after dispersion of the fine particles. When a protection layer is prepared by dispersing the aforementioned surface-treated electroconductive particles in a solution containing a heat-curable or light-curable monomer or oligomer to obtain coating liquid, applying the coating liquid onto a photosensitive layer, and drying and curing the applied coating liquid, the resulting protection layer is more satisfactory in transparency, hardness, and wear resistance.

The heat-curable or light-curable monomer or oligomer is such a molecule that has a functional group causing polymerization by heat or light energy at the end of the molecule, or a functional group causing polymerization by a radical generated by a polymerization initiator. A relatively large molecule having about 2 to 20 repeating structural units is called an oligomer and a smaller molecule is called a monomer. The functional group causing the polymerization include the groups having a carbon-carbon double bond such as an acryloyl group, a methacryloyl group, and a vinyl group; an acetophenone group; a silanol group; the group causing ring-opening polymerization such as a cyclic ether group; and two or more groups reactive together to cause polymerization such as a combination of phenol and formaldehyde.

The electric resistance of the protection layer depends primarily on the ratio of the binder resin to the surface-treated electroconductive particles, and is preferably in the range of from $10^{10}$ to $10^{15}$ Ω·cm, more preferably from $10^{11}$ to $10^{14}$ Ω·cm.

The protection layer in the present invention may further contain an additional additive such as coupling agent and an antioxidant for the purposes of improving dispersibility, binding property, weatherability, and so forth.

The thickness of the protection layer is preferably in a range of from 0.1 μm to 5 μm, more preferably from 0.2 μm to 3 μm.

The photosensitive layer of the electrophotographic photosensitive member of the present invention is described below. The construction of the photosensitive layers of the present invention is classified into two types: a single layer type which contains both a charge-generating substance and a charge-transporting substance in one and the same layer, and a lamination type which comprises a charge-generating layer containing a charge-generating substance and a charge-transporting layer containing a charge-transporting substance. In the present invention, the lamination type is preferable.

The charge-generating layer of the lamination type of photosensitive layer contains a charge-generating substance selected from the materials of inorganic charge-generating substances such as selenium, selenium-tellurium, and amorphous silicon; cationic dyes such as pyrylium dyes, thiapyrylium dyes, azulenium dyes, thiacyanine dyes, and quinone cyanine dyes; squatilium salt dyes; phthalocyanine pigments; polycyclic quinone pigments such as anthanthrone pigments, dibenzopyrenequinone pigments, and pyranthorone pigments; indigo pigments; quinacridone pigments; azo pigments and the like. The above charge-generating substance may be used singly or in combination of two or more thereof. The charge-generating layer may be formed as a vapor-deposition layer by use of a vapor deposition apparatus, or as a coating layer formed by applying and drying a coating liquid containing the charge-generating substance and the binder resin dissolved or dispersed in a suitable solvent. The binder resin is selected from a variety of insulating resins, including polyvinylbutyral, polyarylate (a polycondensate of bisphenol A and phthalic acid), polycarbonate, polyester, polyvinyl acetate, acrylic resins, polyacrylamide, polyamides, cellulose resins, urethane resins, epoxy resins, and polyvinyl alcohol. The binder resin further includes organic photoconductive resins such as poly-N-vinylcarbazole and polyvinylpyrene.

The content of the binder resin in the charge-generating layer is preferably not higher than 80% by weight, more preferably not higher than 40% by weight based on the total weight of the charge-generating layer.

The thickness of the charge-generating layer is preferably not more than 5 μm, more preferably within the range of from 0.01 to 1 μm.

The charge-transporting layer may be formed by applying and drying a solution containing the charge-generating substance and the binder resin dissolved in a suitable solvent. The charge-transporting substance includes polycyclic aromatic compounds having a structure of biphenylene, anthracene, pyrene, phenanthrene, or the like in the main chain or the side chain; nitrogen-containing cyclic compounds such as indole, carbazole, oxadiazole, and pyrazoline; hydrazone compounds, and styryl compounds.

The binder resin for the charge-transporting layer includes polyarylate, polysulfone, polyamide, acrylic resins, acrylonitrile resins, mathacrylic resins, vinyl chloride resins, vinyl acetate resins, phenol resins, epoxy resins, polyester, alkyd resins, polycarbonate, polyurethane, styrene-butadiene copolymers, styrene-acrylonitrile copolymers, styrene-maleic acid copolymers, and the like. The binder resin further includes organic photoconductive resins such as polyvinylcarbazole, polyvinylanthracene, and polyvinylpyrene. The blending ratio of the charge-transporting substance is preferably in a range of from 10 to 500 parts by weight relative to 100 parts by weight of the binder resin.

The thickness of the charge-transporting layer is preferably in a range of from 5 to 40 μm, more preferably from 10 to 30 μm.

In the case where a single layer type of photosensitive layer is employed, the photosensitive layer may be formed by applying and drying a coating liquid containing the charge-generating substance, charge-transporting substance, and the binder resin dispersed or dissolved in a suitable solvent.

The thickness of the photosensitive layer is preferably in a range of from 5 to 40 μm, more preferably from 10 to 30 μm.

Further in the present invention, a subbing layer which has both a barrier function and an adhesive function is preferably provided between the electroconductive support and the photosensitive layer. The material for the subbing layer includes polyvinyl alcohol, polyethylene oxide, ethylcellulose, methylcellulose, casein, polyamide, glue, gelatin and the like. The material is dissolved in a suitable solvent, and applied and dried on the electroconductive support. The thickness thereof is preferably not more than 5 μm, more preferably in a range of from 0.2 to 3.0 μm.

The above-mentioned various layers may be applied by dip coating, spray coating, beam coating, spinner coating, roller coating, Meyer bar coating, blade coating, or the like coating method.

The electroconductive support may be made from a metal such as aluminum, aluminum alloy, copper, zinc, stainless steel, vanadium, molybdenum, chromium, titanium, nickel, indium, gold, and platinum. Otherwise, the support may be a plastic (e.g., polyethylene, polypropylene, polyvinyl chloride, polyethylene terephthalate, acrylic resin, etc.) coated with the above metal or alloy by vapor deposition; the plastic, metal, or alloy coated with an electroconductive particulate material (e.g., carbon black, particulate silver, etc.) dispersed in a binder resin; or a plastic or paper impregnated with an electroconductive particulate material.

The support may be in a drum shape, a sheet shape, a belt shape, or any other shape. The shape is selected to be most suitable for the electrophotographic apparatus employed.

The electrophotographic photosensitive member of the present invention is applicable to electrophotographic apparatuses generally such as copying machines, laser printers, LED printers, and liquid crystal shutter type printers, but it is also applicable widely to apparatuses for display, recording, light printing, engraving, facsimile, and so forth which utilized and electrophotography technique.

FIG. 1 illustrates schematically an example of the constitution of an electrophotographic apparatus employing the electrophotographic photosensitive member of the present invention.

In FIG. 1, a drum type photosensitive member 1 of the present invention is driven to rotate around the axis 1*a* in the arrow direction at a prescribed peripheral speed. The photosensitive member 1 is charged positively or negatively at the peripheral face uniformly during the rotation by an electrostatic charging means 2, and then exposed to image-exposure light L (e.g. slit exposure, laser beam-scanning exposure, etc.) at the exposure portion 3 with an image-exposure means (not shown in the drawing), whereby electrostatic latent images are sequentially formed on the peripheral surface in accordance with the exposed image.

The electrostatic latent image is developed with a toner by a developing means 4. The toner-developed images are sequentially transferred by a transfer means 5 onto a surface of a transfer-receiving material P which is fed between the photosensitive member 1 and the transfer means 5 synchronously with the rotation of the photosensitive member 1 from a transfer-receiving material feeder not shown in the drawing.

The transfer-receiving material P having received the transferred image is separated from the photosensitive member surface, and introduced to an image fixing means 8 for fixation of the image and sent out of the copying machine as a duplicate copy.

The surface of the photosensitive member 1, after the image transfer, is cleaned with a cleaning means 6 to remove any remaining non-transferred toner, and is treated for charge elimination with a pre-exposure means 7 for repeated use for image formation.

The generally employed charging means 2 for uniformly charging the photosensitive member 1 is a corona charging apparatus. The generally employed transfer means 5 is also a corona charging means. In the electrophotographic apparatus, two or more of the constitutional elements of the above described photosensitive member, the developing means, the cleaning means, etc. may be integrated into one device unit, which may be made demountable from the main body of the apparatus. For example, at least one of the charging means, the developing means, and the cleaning means is combined with the photosensitive member 1 into one device unit which is demountable from the main body of the apparatus by aid of a guiding means such as a rail in the main body of the apparatus. An electrostatic charging means and/or a developing means may be combined with the aforementioned device unit.

In the case where the electrophotographic apparatus is used as a copying machine or a printer, the optical image exposure light L may be projected onto the photosensitive member as reflected light or transmitted light from an original copy, or otherwise the information read out by a sensor from an original may be signalized, and light is projected, onto a photosensitive member, by scanning with a laser beam, driving an LED array, or driving a liquid crystal shutter array according to the signal.

Figure 2:
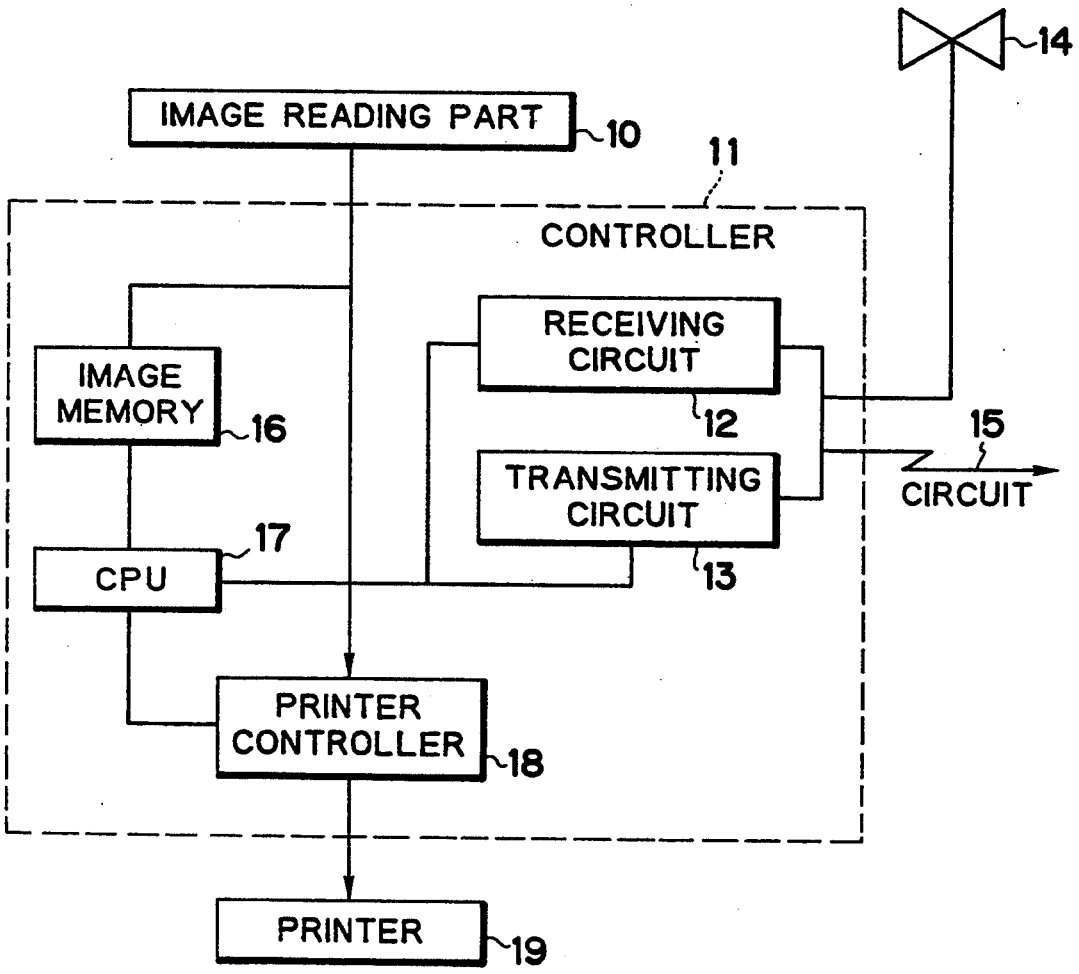
FIG. 2 illustrates an example of block diagram of a facsimile employing the electrophotographic photosensitive member of the present invention.

In the case where the electrophotographic apparatus is used as a printer of a facsimile machine, the optical image exposure light L is employed for printing the received data. FIG. 2 is a block diagram of an example of this case.

A controller 11 controls the image-reading part 10 and a printer 19. The entire of the controller 11 is controlled by a CPU 17. Readout data from the image reading part 10 is transmitted through a transmitting circuit 13 to the other communication station. Data received from the other communication station is transmitted through a receiving circuit 12 to a printer 19. The image data is stored in image memory 16. A printer controller 18 controls a printer 19. The numeral 14 denotes a telephone set.

The image received through a circuit 15, namely image information from a remote terminal connected through the circuit, is demodulated by the receiving circuit 12, treated for compounding of the image information in CPU 17, and successively stored in the image memory 16. When at least one page of image information has been stored in the image memory 16, the images are recorded in such a manner that the CPU 17 reads out the one page of image information, and sends out the compounded one page of information to the printer controller 18, which controls the printer 19 on receiving the one page of information from CPU 17 to record the image information.

During recording by the printer 19, the CPU 17 receives the subsequent page of information.

Images are received and recorded in the manner as described above.

The present invention is described in more detail by reference to Examples without limiting the invention in any way. In the Examples the term "parts" based on weight.

EXAMPLE 1

Onto an aluminum cylinder of 30 mm diameter and 260 mm long, a solution of 10 parts (parts by weight, hereinafter the same) of an alcohol-soluble polyamide resin (Amilan CM-8000, made by Toray Industries, Inc.), and 30 parts of a methoxymethylated 6 nylon resin in a mixed solvent of 150 parts methanol and 150 parts of butanol was applied by dip coating. The applied matter was dried at 90° C. for 10 minutes to form a subbing layer of 1μm thick.

Four parts of disazo pigment represented by the structural formula below:

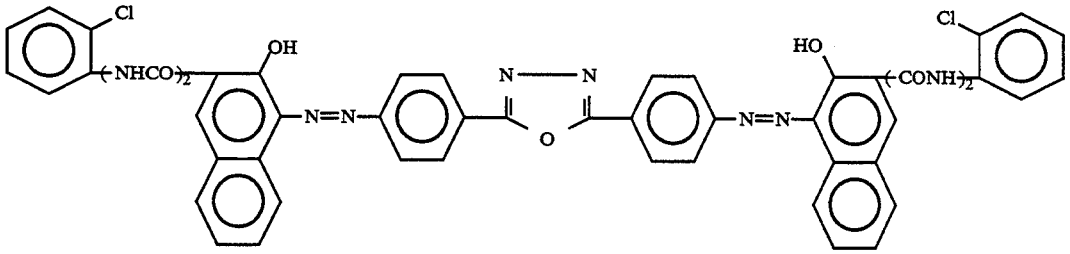

and 2 parts of a butyral resin (Eslec BL-S, made by Sekisui Chemical Co., Ltd.) are dispersed in 100 parts of cyclohexanone by means of a sand mill for 48 hours. 100 parts of tetrahydrofuran (THF) is added to the mixture to prepare the liquid dispersion for charge-generating layer. This liquid dispersion was applied on the subbing layer prepared above by dip coating, and dried at 80° C. for 15 minutes to form a charge-generating layer of 0.15 μm thick.

Then, 10 parts of the styryl compound represented by the structural formula below:

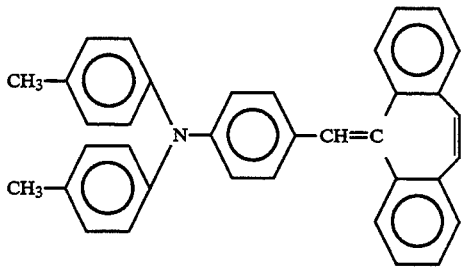

and 10 parts of a polycarbonate resin (IUPILON Z-200, made by Mitsubishi Gas Chemical Co., Inc.) were dissolved in a mixed solvent of 20 parts of dichloromethane and 60 parts of monochlorobenzene. This solution was applied on the charge-generating layer prepared above by dip coating, and dried at 120° C. for 60 minutes to form a charge-transporting layer of 18 μm thick.

Subsequently, the coating liquid for the protection layer was prepared by the procedure below.

100 parts of fine particles of antimony-doped tin oxide having an average particle diameter of 0.02 μm (T-1, made by Mitsubishi Materials Corporation), 10 parts of methylhydrogensilicone oil (KF99, made by Shin-Etsu Silicone Co.), and 300 parts of acetone were agitated by means of an agitation apparatus for 48 hours. The mixture was filtered, and the particles were washed and dried. The particles were further heat-treated at 150° C. for 2 hours, thus the surface treatment of the fine tin oxide particles being accomplished.

Then 50 parts of an acrylic type curable monomer represented by the structural formula below:

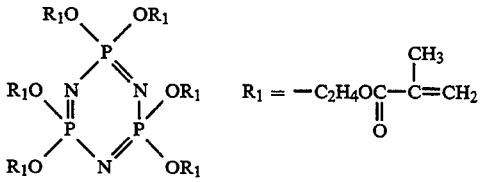

0.1 parts of 2-methylthioxanthone as the photopolymerization initiator, 40 parts of fine particles of the above surface-treated tin oxide, and 300 parts of toluene were mixed, and dispersed by means of a sand mill for 96 hours. Thus the coating liquid for a protection layer was prepared.

This coating liquid was applied by spray coating and dried on the charge-transporting layer prepared above. Then the resulting layer was exposed to UV irradiation with a high-pressure mercury lamp at an intensity of 8 mW/cm$^2$ for 20 seconds. Thus a protection layer of 5 μm thick, and a photosensitive member was completed.

The resulting electrophotographic photosensitive member was mounted on a copying machine which repeats the processes of charging, exposure, development, transfer, and cleaning at a cycle time of 1.5 seconds, and the electrophotographic characteristics of the photosensitive member were evaluated at a normal temperature of 20° C. under a normal humidity of 50% (N/N). The electrophotographic characteristics were evaluated by measuring the surface potential (dark area potential) of the photosensitive member on corona discharge at −5 KV, quantity of light exposure (sensitivity) necessary for decreasing the surface potential of the photosensitive member from −700V to −200v, and the residual potential. Further, the quality of images was evaluated visually with the images formed at normal temperature and normal humidity, at a low temperature and low humidity conditions (L/L) of 10° C. and 15%, and at a high temperature and high humidity (H/H) of 35° C. and 85%. Furthermore, the durability of the photosensitive member was tested by 100,000 sheets of successive copying at each environment.

The results are shown in Table 1.

EXAMPLE 2

A photosensitive member was prepared and evaluated in the same manner as in Example 1 except that the coating liquid for the protection layer was changed as shown below.

100 parts of fine particles of antimony-doped tin oxide having an average particle diameter of 0.02 μm (T-1, made by Mitsubishi Materials Corporation), 5 parts of methylhydrogensilicone oil (KF99, made by Shin-Etsu Silicone Co.), and 300 parts of methyl ethyl ketone were agitated by means of an agitation apparatus for 48 hours. The mixture was filtered, and the particles were washed and dried. The particles were further heat-treated at 180° C. for 2 hours, thus the surface treatment of the fine tin oxide particles being accomplished.

Then 20 parts of an acrylic type curable monomer represented by the structural formula below:

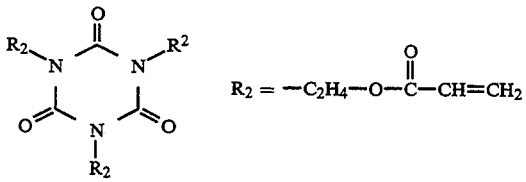

20 parts of a bisphenol Z type polycarbonate resin (weight-average molecular weight: 20,000), 0.1 parts of 2-methylthioxanthone as the photopolymerization initiator, 40 parts of fine particles of the above surface-treated tin oxide, and 300 parts of toluene were mixed, and dispersed by means of a sand mill for 96 hours. Thus the coating liquid for a protection layer was prepared.

The results are shown in Table 1.

EXAMPLE 3

A photosensitive member was prepared and evaluated in the same manner as in Example 1 except that the coating liquid for the protection layer and the method of formation of the protection layer were changed as shown below.

100 parts of fine particles of tin-doped indium oxide having an average particle diameter of 0.02 μm (ITO, made by Mitsubishi Materials Corporation), 30 parts of methylhydrogensilicone oil (KF99, made by Shin-Etsu Silicone Co.), and 300 parts of toluene were agitated by means of an agitation apparatus for 60 hours. The mixture was filtered, and the particles were washed and dried. The particles were further heat-treated at 150° C. for 3 hours, thus the surface treatment of the fine indium oxide particles being accomplished.

Then 45 parts of methyltrimethoxysilane, 50 parts of the above surface-treated fine indium oxide particles, and 300 parts of isopropyl alcohol were mixed, and dispersed by means of a sand mill for 96 hours. Thus the coating liquid for a protection layer was prepared.

With this coating liquid, the protection layer of 3 μm thick was prepared by dip coating and heating at 160° C. for one hour.

The results are shown in Table 1.

EXAMPLE 4

A photosensitive member was prepared and evaluated in the same manner as in Example 1 except that the methylhydrogensilicone oil had a weight-average molecular weight of 2,000, and the hydrogen atom ratio thereof was 39%.

The results are shown in Table 1.

EXAMPLE 5

A photosensitive member was prepared and evaluated in the same manner as in Example 1 except that the methylhydrogensilicone oil had a weight-average molecular weight of 3,200, and the hydrogen atom ratio thereof was 26%.

The results are shown in Table 1.

COMPARATIVE EXAMPLE 1

A photosensitive member was prepared and evaluated in the same manner as in Example 1 except that no protection layer was provided.

The results are shown in Table 1.

COMPARATIVE EXAMPLE 2

A photosensitive member was prepared and evaluated in the same manner as in Example 1 except that the electroconductive fine particles for the protection layer were not subjected to surface treatment.

The results are shown in Table 1.

COMPARATIVE EXAMPLE 3

A photosensitive member was prepared and evaluated in the same manner as in Example 1 except that dimethylsiloxane (weight-average molecular weight: 3,000) was used in place of the methylhydrogensilicone oil.

The results are shown in Table 1.

COMPARATIVE EXAMPLE 4

A photosensitive member was prepared and evaluated in the same manner as in Example 1 except that a silicone coupling agent represented by the formula below was used in place of the methylhydrogensilicone oil:

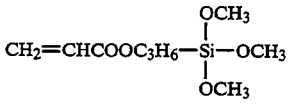

The results are shown in Table 1.

As understood from Table 1, the electrophotographic photosensitive member of the present invention has excellent electrophotographic characteristics, and gives excellent image under any environmental conditions.

On the contrary, in Comparative Example 1, the surface of the photosensitive member came to be abraded significantly during the successive copying test, and the potential contrast became low by 50,000 sheets of successive copying to cause decrease of image density. Further, under high-temperature and high-humidity conditions, running of the image occurred by 20,000 sheets of successive copying: the running of the image being in streaks in the direction of rotation of the photosensitive member and being caused by drop of the electric resistance at the surface of the photosensitive member resulting from adhesion of corona discharge products and paper powder. In Comparative Example 2, blurring of image, which is image defect caused by running of electrostatic latent image resulting from drop of electric resistance at the surface of the photosensitive member, occurred under normal-temperature and normal humidity conditions by 5,000 sheets of successive copying, and under high-temperature and high-humidity conditions by about 2,000 sheets of successive copying, and image running occurred under high-temperature and high-humidity conditions by 3,000 sheets of successive copying. In Comparative Example 3, image blurring occurred under high-temperature and high-humidity conditions by 60,000 sheets of successive copying. In Comparative Example 4, image blurring occurred under high-temperature and high-humidity conditions by 50,000 sheets of successive copying.

TABLE 1

| | Electrophotographic characteristics N/N | | | Image quality N/N | | Image quality L/L | | Image quality H/H | |
|---|---|---|---|---|---|---|---|---|---|
| | Dark area potential (−V) | Sensitivity (lux · sec) | Residual potential (−V) | Initial stage | After 100,000 sheets of copying | Initial stage | After 100,000 sheets of copying | Initial stage | After 100,000 sheets of copying |
| Example | | | | | | | | | |
| 1 | 1030 | 1.9 | 15 | good | good | good | good | good | good |
| 2 | 1030 | 1.9 | 15 | good | good | good | good | good. | good |
| 3 | 1020 | 2.0 | 15 | good | good | good | good | good | good |
| 4 | 1030 | 2.0 | 15 | good | good | good | good | good | good |
| 5 | 1000 | 1.9 | 15 | good | good | good | good | good | good |
| Comparative example | | | | | | | | | |
| 1 | 970 | 1.8 | 10 | good | density low | good | good | good | image running |
| 2 | 1000 | 2.0 | 30 | good | image blurred | good | good | good | image running image blurred |
| 3 | 1020 | 1.9 | 20 | good | good | good | good | good | image blurred |
| 4 | 1010 | 1.9 | 30 | good | good | good | good | good | image blurred |

What is claimed is:

1. An electrophotographic photosensitive member, comprising an electroconductive support, a photosensitive layer, and a protection layer in named order, the protection layer containing a binder resin and an electroconductive particle, the electroconductive particle having a polymer coating prepared by cross-linking a siloxane compound represented by the following Formula (1):

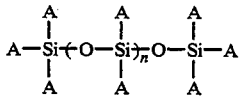

(1)

wherein A group is a hydrogen atom or a methyl group, the ratio of the number of the hydrogen atoms to the total number of the A groups is in a range of from 0.1 to 50%, and n is an integer of 0 or more.

2. An electrophotographic photosensitive member according to claim 1, wherein the ratio of the number of the hydrogen atoms to the total number of the A groups is in a range of from 35 to 50%.

3. An electrophotographic photosensitive member according to claim 1, wherein the siloxane compound of Formula (1) is represented by the formula below:

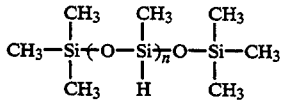

wherein n is an integer of 0 or more.

4. An electrophotographic photosensitive member according to claim 1, wherein n is an integer of from 10 to 100.

5. An electrophotographic photosensitive member according to claim 4, wherein n is an integer of from 30 to 70.

6. An electrophotographic photosensitive member according to claim 1, wherein the siloxane compound of Formula (1) has a weight-average molecular weight in a range of from 300 to 10,000.

7. An electrophotographic photosensitive member according to claim 6, wherein the siloxane compound of Formula (1) has a weight-average molecular weight in a range of from 1,000 to 4,000.

8. An electrophotographic photosensitive member according to claim 1, wherein the siloxane compound of Formula (1) is represented by the formula below:

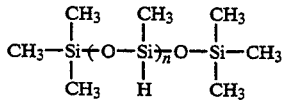

wherein n is an integer in a range of from 30 to 70, and has a weight-average molecular weight in a range of from 1,000 to 4,000.

9. An electrophotographic photosensitive member according to claim 1, wherein the polymer forms a three-dimensional structure.

10. An electrophotographic photosensitive member according to claim 1, wherein the electroconductive particle material is a metal oxide.

11. An electrophotographic photosensitive member according to claim 10, wherein the electroconductive particle is selected from the group of tin oxide, indium oxide, tin-doped indium oxide, and antimony-doped tin oxide.

12. An electrophotographic photosensitive member according to claim 1, wherein the electroconductive particle material in the protection layer has an average particle diameter of not more than 0.3 μm.

13. An electrophotographic photosensitive member according to claim 12, wherein the electroconductive particle material in the protection layer has an average particle diameter of not more than 0.1 μm.

14. An electrophotographic photosensitive member according to claim 1, wherein the binder resin is a heat-curable resin.

15. An electrophotographic photosensitive member according to claim 1, wherein the protection layer has electric resistance in a range of from $10^{10}$ to $10^{15}$ Ω·cm.

16. An electrophotographic photosensitive member according to claim 15, wherein the protection layer has electric resistance in a range of from $10^{11}$ to $10^{14}$ Ω·cm.

17. An electrophotographic photosensitive member according to claim 1, wherein the protection layer contains at least one additive selected from the group consisting of coupling agents and antioxidants.

18. An electrophotographic photosensitive member according to claim 1, wherein the photosensitive layer comprises a charge-generating layer and a charge-transporting layer.

19. An electrophotographic photosensitive member according to claim 1, wherein the electrophotographic photosensitive member has a subbing layer between the photosensitive layer and the electroconductive support.

20. An electrophotographic apparatus, comprising an electrophotographic photosensitive member, an image forming means for forming an electrostatic latent image, a developing means for developing the formed latent image, and a transferring means for transferring a developed image to a transfer-receiving material; said electrophotographic photosensitive member comprising an electroconductive support, a photosensitive layer, and a protection layer in named order, the protection layer containing a binder resin and an electroconductive, particle, the electroconductive particle having a polymer coating prepared by cross-linking a siloxane compound represented by the following Formula (1):

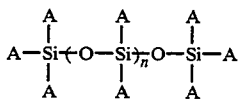

(1)

wherein A group is a hydrogen atom or a methyl group, the ratio of the number of the hydrogen atoms to the total number of the A groups is in a range of from 0.1 to 50%, and n is an integer of 0 or more.

21. A device unit comprising an electrophotographic photosensitive member and at least one means selected from a charging means, a developing means, and a cleaning means; said electrophotographic photosensitive member comprising an electroconductive support, a photosensitive layer, and a protection layer in named order, the protection layer containing a binder resin and an electroconductive particle, the electroconductive particle having a polymer coating prepared by cross-linking a siloxane compound represented by the following Formula (1):

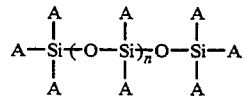

(1)

wherein A group is a hydrogen atom or a methyl group, the ratio of the number of the hydrogen atoms to the total number of the A groups is in a range of from 0.1 to 50%, and n is an integer of 0 or more; and said unit holding integrally the electrophotographic photosensitive member and said at least one means selected from a charging means, a developing means, and a cleaning means, and being demountable from the main body of an electrophotographic apparatus.

22. A facsimile machine comprising an electrophotographic apparatus and an information-receiving means for receiving image information from a remote terminal; said electrophotographic apparatus comprising an electrophotographic photosensitive member; and said electrophotographic photosensitive member comprising an electroconductive support, a photosensitive layer, and a protection layer in named order, the protection layer containing a binder resin and an electroconductive particle, the electroconductive particle having a polymer coating prepared by cross-linking a siloxane compound represented by the following Formula (1):

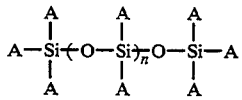

(1)

wherein A group is a hydrogen atom or a methyl group, the ratio of the number of the hydrogen atoms to the total number of the A groups is in a range of from 0.1 to 50%, and n is an integer of 0 or more.

23. An electrophotographic photosensitive member according to claim 1, wherein the electroconductive particle is formed by applying thereto the siloxane compound represented by the Formula (1) and subsequently heat-treating the particle at a temperature of not lower than 120° C.

* * * * *

UNITED STATES PATENT AND TRADEMARK OFFICE

CERTIFICATE OF CORRECTION

PATENT NO. : 5,385,797

DATED : January 31, 1995

INVENTOR(S) : SHIN NAGAHARA, ET AL.

It is certified that error appears in the above-identified patent and that said Letters Patent is hereby corrected as shown below:

COLUMN 1

Line 24, "member" should read --members--.

COLUMN 3

Line 47, "atom" should read --atoms--.

COLUMN 4

Line 3, "articles." should read --particles.--.
Line 15, "the the" should read --the--.
Line 67, "ultra" should read --ultra- --.

COLUMN 5

Line 35, "include" should read --includes--.

COLUMN 6

Line 5, "squatilium" should read --squarilium--.
Line 8, "pyranthorone" should read --pyranthrone--.

COLUMN 7

Line 38, "utilized and" should read --utilize an--.

COLUMN 8

Line 11, "above described" should read --above-described--.
Line 40, "entire" should read --entirety--.

UNITED STATES PATENT AND TRADEMARK OFFICE

CERTIFICATE OF CORRECTION

PATENT NO. : 5,385,797

DATED : January 31, 1995

INVENTOR(S) : SHIN NAGAHARA, ET AL.

It is certified that error appears in the above-identified patent and that said Letters Patent is hereby corrected as shown below:

COLUMN 9

Line 1, "based" should read --is based--.

COLUMN 14

Line 38, "material" should be deleted.
Line 46, "material" should be deleted.
Line 50, "material" should be deleted.

COLUMN 15

Line 16, "electroconductive," should read --electroconductive--.

Signed and Sealed this

Ninth Day of May, 1995

Bruce Lehman

*Attest:*

BRUCE LEHMAN

*Attesting Officer*

*Commissioner of Patents and Trademarks*